United States Patent [19]

O'Brien

[11] 3,954,659

[45] May 4, 1976

[54] METHOD OF FORMING STABLE DISPERSIONS OF ALUMINA

[75] Inventor: James H. O'Brien, Columbia, Mo.

[73] Assignee: Philadelphia Quartz Company, Valley Forge, Pa.

[22] Filed: Feb. 5, 1974

[21] Appl. No.: 439,799

Related U.S. Application Data

[63] Continuation of Ser. No. 210,245, Dec. 20, 1971, abandoned.

[52] U.S. Cl. ..... 252/313 R; 106/36; 252/317; 428/538

[51] Int. Cl.[2] ..... B01J 13/00

[58] Field of Search ..... 252/313 R; 106/36

[56] References Cited

UNITED STATES PATENTS

| | | | |
|---|---|---|---|
| 2,590,833 | 4/1952 | Bechtold et al. | 252/313 R |
| 2,787,522 | 4/1957 | Lefrancois | 252/313 R X |
| 2,915,475 | 12/1959 | Bugosh | 252/313 R |

*Primary Examiner*—Richard D. Lovering
*Attorney, Agent, or Firm*—Fred Philpitt; Ernest Posner

[57] ABSTRACT

Stable aqueous dispersions of alumina are formed at concentrations of above about 25% $Al_2O_3$ by dispersing alumina dried with a strongly acidic solution. Said stable aqueous dispersions of alumina are stable for at least 2.5 months.

3 Claims, No Drawings

METHOD OF FORMING STABLE DISPERSIONS OF ALUMINA

This is a continuation of application Ser. No. 210,245, filed Dec. 20, 1971, and now abandoned.

It has been known for many years that the application of dispersions of finely divided silica or sols of silica to paper surfaces increases the friction between those surfaces. More recently it has been found that the use of dispersions or aerosols of alumina increases friction even more and that such aerosol alumina is more strongly attached to the paper so that the non-slip characteristic is maintained through three or four passes, even though much less alumina is required. For instance, an uncoated paper may have an angle of repose of 29°–35° in a standard slip testing device. The same paper, when treated with a dispersion of colloidal silica may have an angle of repose of 39°–41°, and often better results may be obtained using a lower concentration of alumina as the treating liquid than is necessary for silica. These angles depend to a large degree on the particular paper employed.

It is well known that aerosols of alumina are very expensive compared to sols or dispersions of finely divided alumina. Precipitated colloidal alumina or alumina gel, dispersed with strong acid at about a pH of 3 is approximately equivalent to the aerosol alumina in performance, but it cannot be formed into dispersions of above about 10% $Al_2O_3$ which are stable for more than about a week. These are not really satisfactory for commercial use. It has also been known to increase the stability of such dispersions by partially removing the acid ions by ionic exchange resins. These are also not sufficiently stable at concentrations above about 15% $Al_2O_3$, but what I have found is that stable dispersions may be formed at concentrations above about 25% alumina by preparing an aqueous solution at a pH of about 1 to 3 and then adding into this solution with vigorous mixing sufficient amorphous alumina monohydrate to form a concentration of about 10–30%, thus forming a dispersion at a pH of about 1.0 to 3.5. This dispersion is then dried at about 150° C. The temperature may range from about 100° C to about 200° C at atmospheric pressure and lower temperatures at reduced pressure. Thus, overall, the drying treatment may be carried out over a range of 0.1 to 1 Atm and 50°–200° C. The product after drying is crushed and redispersed in water at a concentration of 25–30% or more as desired, and such dispersions are stable for at least four months. The pH of a 25 to 30% dispersion, while preferably at 3.2 to 3.4, may range from about 3.0 to 4.0, and a 25% dispersion will have a viscosity of about 5 cP at 25° C, and about 6 cP at 30% dispersion.

It makes no difference whether the dispersion is dried in a tray or spray dried. However it must not be overdried as, for instance, not more than about 12 hours at 150° C. Either process will form a satisfactory product which can be redispersed to form a stable colloidal solution at the above concentrations. It must merely be dried sufficiently to crush to a free-flowing powder. Furthermore, this dispersion when applied to paper is at least as good as the aerosol alumina in increasing the angle of slippage; that is improving the resistance to slippage of the paper surface.

In general, this solution is diluted before use to about 1 to 5% of $Al_2O_3$ although much higher concentrations, as for instance 20%, may be used.

The application is about 0.05 to 0.6 lbs. of alumina solids per 1000 sq. ft. of paper or paperboard.

For untreated bags or boxes, which start to slip at 25°, the angle may be raised to 40° before slippage if the surface is treated with at least about 0.15 lbs. per 1000 sq. ft. of alumina, whereas the use of colloidal silica usually requires at least about 0.6 lbs. per 1000 sq. ft. to achieve the same value.

This dispersion may be applied by known methods. The usual method is to apply the solution using a felt or a sponge, although it may be applied with a contact roller or it may be sprayed, for instance using a paint sprayer.

The following examples describe in general the process of preparing these dispersions and their use on the paper, and are not to be construed as restrictive of the invention.

In the following examples I have used a form of alumina which I will call "Alumina A". It has a particle size in solution of about 5 millimicrons. This alumina contains about 90% of alumina monohydrate, 10% water, and other impurities total about 0.9%. The surface area is by the BET method and is approximately 295 sq. meters per gram or higher.

EXAMPLE 1

In this example a 10% dispersion was prepared using the ordinary procedure. Thus an acid solution containing 0.8 parts by weight of concentrated HCl (37%) and 89.2 parts by weight of water was prepared at a pH of 1.2. To this was added, with moderate agitation, 10 parts by weight of the Alumina A described above. Mixing was continued for 15 minutes. A stable dispersion was prepared which had a pH of 2.3 at 1 hour and stabilized at 3.3 in 24 hours and formed a thixotropic gel after one month standing at room temperature. After 7 weeks, the dispersion was very viscous, but could be redispersed in water.

A similar dispersion was made with aerosol alumina, known as CAB-O-GRIP, a trademark of the Cabot Corporation. The dispersion had a pH of 3.8.

EXAMPLE 2

25 and 30% dispersions of the alumina of this invention were prepared as follows: 73.7 parts of water were mixed thoroughly with 1.3 parts of concentrated HCl (37.5%) to form solution I with a pH of 0.9. Following this, 25 parts of Alumina A was added slowly to the acidic solution I just prepared and allowed to mix for 15 minutes at a mixing speed of 250 rpm.

This dispersion was found to have a pH of 1.7. The dispersion was then placed in open containers and heated in an oven for 9 to 12 hours at 150° C. After the water had been evaporated and a dried powder had been formed, the dry product was removed and crushed to a uniform powder and redispersed in water at 25 and 30% alumina concentration. The pH was found to be 3.2 to 3.8, and the viscosity was 5.2 cP at 25% and 6.1 at 30% alumina at 25° C. The 25% dispersion remained stable with very little viscosity change in over 4 months. It was found that overheating produces an alumina which is not dispersible and settles out easily. A 30% dispersion, frozen for 2.5 months, became a stable dispersion on merely thawing.

EXAMPLE 3

A dispersion of the Alumina A was made as in example 2. The 25% dispersion was then pumped into a spray dryer with an atomizer pressure of 5 kg/cm$^2$ and an inlet temperature of 200° C and an outlet temperature of 75° C. The feed rate was adjusted so that the outlet temperature remained constantly at 75° C. The dry product was redispersed at 25% solids in water, and this dispersion had a pH of 3.2 to 3.8, and a viscosity of 4.2 cP at 23° C. These products are also stable for several months at concentrations of 25% $Al_2O_3$.

Slide angle tests were made with these products. These tests were carried out by the standard TAPPI method No. 503.

Paper was preconditioned at 73° F and 50% relative humidity. The dispersions were diluted from 1 to 5% $Al_2O_3$ depending upon the amount of coating required, and this dilute concentration of alumina was sprayed on the paper surface. After coating, the treated paper was again conditioned at 73° F and 50% relative humidity for 24 hours. Sections of the treated paper were cut to fit the slide angle tester and a standard size section was cut and weighed to determine the loading. The slide angle was measured according to the standard method by raising the tester with a constant speed motor at a rate of 1.5° per second. The paper was placed in cross-grained position. The angle of inclination was observed at the point when the weight began to slide. The first two slides are run to precondition the surface and the third slide is the determined value.

At a loading of 0.1 lbs/1000 ft$^2$ of paper surface a slide angle of 31.5° was determined using a Syton HT-40 dispersion of silica; with the CAB-O-GRIP dispersion mentioned in Example 1 above at the same loading, the slide angle was 32.2°.

The first alumina dispersion described in Example 1 was diluted and applied at 0.1 lbs/1000 ft$^2$loading; the slide angle was 33.7°.

The dispersion formed from Example 2 had an angle of 35.8°, and , formed from Example 3 had a slide angle of about 35°.

The untreated board had a slide angle of 25.7°.

At a loading of about 0.4 lbs/1000 ft$^2$, the Syton HT-40 had a slide angle of 33.3°, whereas the CAB-O-GRIP at this loading had a slide angle of about 37.5°, and the Alumina A had a slide angle of about 37°. The product of Example 2 had approximately the same slide angle of 37°, whereas in Example 3 the slide angle was about 37.5°.

EXAMPLE 4

A satisfactory free-flowing tray dried powder was formed by drying the initial dispersion of Example 2 in a vacuum evaporator at 20 mm of Hg and 60° C. A 30% dispersion of the dried powder had a pH of 3.4 and is stable for at least 2.5 months.

More or less detailed claims will be presented hereinafter and even though such claims are rather specific in nature those skilled in the art to which this invention pertains will recognize that there are obvious equivalents for the specific materials recited therein. Some of these obvious equivalents are disclosed herein, other obvious equivalents will immediately occur to one skilled in the art, and still other obvious equivalents could be readily ascertained upon rather simple, routine, noninventive experimentation. Certainly no invention would be involved in substituting one or more of such obvious equivalents for the materials specifically recited in the claims. It is intended that all such obvious equivalents be encompassed within the scope of this invention and patent grant in accordance with the well known doctrine of equivalents, as well as changed proportions of the ingredients which do not render the composition unsuitable for the disclosed purposes. Therefore, this application for Letters Patent is intended to cover all such modifications, changes and substitutions as would reasonably fall within the scope of the appended claims.

What I claim is:

1. A method of forming stable dispersions of substantially colloidal alumina at concentrations above about 25% $Al_2O_3$ said stable dispersions being stable for at least 2.5 months, in which:

a. an aqueous hydrochloric acid solution is prepared at a pH of from about 1.0 to 3.0;

b. colloidal alumina monohydrate is added to said aqueous solution with vigorous mixing, forming a concentration of about 10 to 30% and a dispersion with a pH of about 1.0 to 3.5;

c. said dispersion is dried at a temperature from about 50°C to 200°C at 0.1 to 1 Atm;

d. the dried dispersion is crushed and redispersed in water to form a dispersion of above about 25% $Al_2O_3$.

2. The method of claim 1 in which the dispersion is spray dried.

3. The method of claim 1 in which the dispersion is tray dried.

* * * * *